US007137630B2

(12) United States Patent
Yurkins

(10) Patent No.: US 7,137,630 B2
(45) **Date of Patent: *Nov. 21, 2006**

(54) COMBINATION POKER AND BLACKJACK CASINO CARD GAME

(75) Inventor: Jerome J. Yurkins, Brooklyn, NY (US)

(73) Assignee: Po-Jack LLC, Briarcliff Manor, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/866,518

(22) Filed: Jun. 11, 2004

(65) Prior Publication Data

US 2005/0116414 A1 Jun. 2, 2005

(51) Int. Cl.
*A63F 1/00* (2006.01)

(52) U.S. Cl. ..... 273/292; 273/274; 273/309

(58) Field of Classification Search ..... 273/292
See application file for complete search history.

(56) References Cited

U.S. PATENT DOCUMENTS

| | | | | | |
|---|---|---|---|---|---|
| 5,141,234 | A * | 8/1992 | Boylan et al. | 463/12 |
| 5,174,579 | A * | 12/1992 | Griffiths | 273/292 |
| 5,265,882 | A * | 11/1993 | Malek | 273/292 |
| 5,282,633 | A * | 2/1994 | Boylan et al. | 273/306 |
| 5,322,295 | A * | 6/1994 | Cabot et al. | 273/292 |
| 5,395,120 | A * | 3/1995 | Malek | 273/292 |
| 6,206,373 | B1 * | 3/2001 | Garrod | 273/292 |
| 6,446,972 | B1 * | 9/2002 | Brunelle | 273/292 |
| 6,547,246 | B1 * | 4/2003 | Webb | 273/292 |
| 6,637,747 | B1 * | 10/2003 | Garrod | 273/292 |
| 6,749,200 | B1 * | 6/2004 | Yurkins | 273/292 |
| 2004/0183256 | A1 * | 9/2004 | Ko | 273/292 |
| 2005/0051960 | A1 * | 3/2005 | Snow | 273/274 |

* cited by examiner

*Primary Examiner*—Stephen Blau
*Assistant Examiner*—Dolores R. Collins
(74) *Attorney, Agent, or Firm*—Abelman, Frayne & Schwab

(57) ABSTRACT

A method of playing a wagering card game named Pojack includes selected elements of the games of Blackjack and Poker, Pojack being played between a dealer and one or more players, where the dealer deals from a stack of cards containing a plurality of standard 52-card decks of cards and the Poker payout odds are predetermined. This game has rules wherein:

a. each player elects to play Blackjack or Poker or both by placing a Blackjack bet or a Poker ante bet or both respectively, b. then the dealer deals according to standard Blackjack procedure to all those players who elected to play Blackjack, c. then before the dealer turns over his hole card and before he makes the Blackjack payout or collection to the players playing Blackjack, each player who previously made a Poker bet is invited to play Poker using his Blackjack hand as the beginning of his Poker hand by placing a Poker raise bet, d. then each player electing to play Poker places his raise bet, e. then the dealer turns over his hole card and makes Blackjack payouts to or collects from all Blackjack players of that Blackjack hand, f. then the dealer deals sequentially to each of said players who elected to play Poker, where each of said Poker players is dealt sufficient cards so that his hand includes a total of five cards to comprise a standard Poker hand, this step being modified such that;

g. then the dealer completes his own Poker hand, and h. then the dealer pays out or collects on all Poker ante and raise bets of all the players playing this Poker hand, according to the predetermined Poker payout odds.

18 Claims, 2 Drawing Sheets

COMBINATION POKER AND BLACKJACK CASINO CARD GAME

BACKGROUND OF THE INVENTION

1. Field of the Invention

This invention is in the field of wagering card games and more particularly in the games of Blackjack and Poker as played in a casino with the house dealer, multiple players and established rules for playing and betting.

2. Description of Related Art

Poker and Blackjack are two well known card games played by two or more persons, sometimes casually for fun and often for serious wagering and entertainment in a casino where there are standard card tables, seating arrangements, house dealers and house rules, security and protocols.

The standard games of Blackjack and Poker as played in casinos players have their strategies and the casinos have their betting and Bonus payoffs. In Blackjack it is now standard practice to use six to eight standard 52-card decks of cards, as compared to the still standard procedure of using a single, standard 52-card deck of cards in Poker.

Over time people have developed variations in each of these games seeking to make them more interesting, exciting and/or challenging. A few attempts have been made to develop games combining features of both Poker and Blackjack. Some of the features of Poker and Blackjack variations are described in the U.S. patents summarized below.

U.S. Pat. No. 4,836,553 discloses Poker game in which five cards are dealt to each player and the dealer. Should the dealer not have an ace and a king or better each player wins, but if the dealer has an ace and a king or better then standard Poker hands establish the winner between each player and the dealer. Betting is coupled into each possible winning scenario.

U.S. Pat. No. 4,861,041 describes methods of progressive jackpot gaming in which either a live gaming table or a token accepting electro-mechanical apparatus is utilized. A cumulative jackpot is included and bettors win either all or a portion of this jackpot by having a hand containing a predetermined arrangement of cards.

Malek has developed casino games presented in related U.S. Pat. Nos. 5,265,882; 5,328,189; and 5,395,120. The '882 game is a combination of Blackjack, draw Poker, and baccarat in which each player plays at least two of the three games against the dealer and other players. In the '189 game Blackjack and baccarat are combined and each player can play both games against the dealer and other player. For the '120 game, the games of modified draw Poker and Blackjack are mixed into a situation in which each player bets and plays against other players and the house dealer.

A method of playing a multiple-hand card game is presented in U.S. Pat. No. 5,322,295. The game involves multiple bettings. As each bet or wager is made a portion of the hand is dealt.

U.S. Pat. No. 5,417,430 relates to a progressive wagering method and game. A game wager and optional jackpot bet are made before the cards are dealt. The dealer then deals two cards to him/herself and three to each player, all face down. Wagers and jackpot bets are then decided in a stepwise manner.

A method and apparatus for playing a Poker-like game are presented in U.S. Pat. No. 5,486,005. After wagers are made an array of seven hands, each with four cards face-up are dealt by the dealer. A variety of final betting combinations are then selected by the players and three more cards are dealt face-up. The dealer then determines the winners and losers. Option jackpot means are provided.

Wagering games are described in many publications, such as U.S. Pat. No. 5,288,081 to which discloses a variation of the well-known game of five card stud Poker. This patent discloses a method of playing a Poker game which involves placing a multi-part wager and then being allowed to withdraw a portion of the wager. Such control over portions of the wager increases player participation and enjoyment.

Similarly, other variations in wagering structures can also increase the excitement and acceptance of such wagering games. U.S. Pat. No. 5,417,430 discloses a Poker game with an altered wagering scheme thus allowing the player the opportunity to compete for an additional prize or payout.

Further wagering games are disclosed in U.S. Pat. Nos. 5,861,041 and 5,087,405 (both to Jones et al.) which both disclose a progressive jackpot game. U.S. Pat. No. 4,836,553 discloses a modified five card stud Poker game.

Other variations can be made to standard games to allow more player opportunity and involvement. U.S. Pat. No. 5,098,107 discloses a game wherein additional symbols are added to increase wagering opportunities. This allows the player the opportunity to place several wagers on different portions of the game while the game is being played. Somewhat similarly, U.S. Pat. No. 3,667,757 discloses a board game wherein the player is given choices regarding alternative strategies for play. Naturally the different strategies chose have different payoff results.

Many different wagering games presently exist for use in both home and casino environments. Such games should necessarily be exciting, uncomplicated and easy to learn so as to avoid frustrating the players. Card games such as Poker and Blackjack have gained widespread popularity because of their established ranking of hands and well-known rules. Furthermore, each of these games usually involves continuous wagering opportunities for the players, thus increasing player participation and excitement. Lastly, the games move fairly quickly to maintain action and activity. All of these factors have created games which are widely accepted and widely known.

One method of increasing the excitement and attraction of wagering games is the inclusion of additional wagering opportunities and payout schemes. For example, in a progressive jackpot scheme certain outcomes are designated to pay out a progressive amount. In this progressive jackpot scheme, a portion of each wager is provided to the progressive jackpot thereby increasing the jackpot amount.

Another method of increasing excitement for the players is to provide additional winning hands or winning possibilities. This has previously been accomplished by such means as adding jokers or wild cards to Poker games. These additional winning opportunities can be accomplished by providing the player with the additional wagering opportunities or by providing additional winning combinations of cards.

Wagering games, and particularly card wagering games, typically exist in two formats: (1) table games, and (2) video games. Table games have existed for a long period of time wherein cards are dealt to the player by a single dealer and play commences from that point. Furthermore, the rules and practices for table games are well understood and easy to follow. As previously mentioned, this makes the wagering game more attractive and well accepted.

Video wagering games have also increased in popularity due to their ease of play. These games are set up to mimic a table game using adaptations of table games rules and cards. Video games are also attractive to both players and gaming establishments because they can be played without the need for a dealer. This provides the players with the opportunity to play the video game in a somewhat isolated environment. Furthermore, the use of a video format conveniently provides many additional dealing possibilities. For example, some methods of dealing cards can be easily carried out through a video configuration, wherein such dealing would be impractical at a table game. For example, it is difficult for the dealer to shuffle and keep separate multiple decks of cards.

Gambling with card games in casino environments includes some obvious and many very subtle aspects. Of the latter, it must be realized that operating a casino is serious business including not only the physical structure of game rooms, card tables, dealers and cards, but more particularly business acumen for attracting vast numbers of players for vast numbers of days, weeks, months, etc., preferably with regularity. To a large extent, these players are having fun, and of course for some it is a business (usually unprofitable). For casinos to be continuously successful month-after-month and year-after-year, they have tried to provide the players with variations on popular old games such as Poker and Blackjack, one notable success being the game of Caribbean Poker.

Another aspect of casino operation which greatly concerns both operators and players is the time that players are actually seated and playing at the card tables. Both the casinos and the players seek maximum playing time, and often players wait in line for a considerable time behind seated players in order to have the opportunity to sit and play.

Of most significant interest is the arrangement or ritual whereby casinos encourage players to come to their respective casinos with enticements of complementary gifts, in the form of free or reduced air fare, hotel rooms, theatre tickets, meals, etc. These "comps" may range in quality from moderate to ultra-first class and may have very considerable monetary and prestige value. However, for a player to consistently receive valuable "comps" he/she must have extensive "playing" time at the tables, and thus must first obtain a seat and then be interested enough to stay in it or obtain a seat at another table. If a player becomes bored with playing Poker, for example, and elects to continue gambling at Blackjack, he will have to abandon his seat at the Poker table and seek a seat at a Blackjack table. Such new seat might not be available for quite a while, and the result is less playing time and less "comp" credits from the players' point of view and less gambling time and less profits from the casino's point of view.

In view of the above, it is apparent that the players who feel good and are not bored will achieve more playing time and more "comp" credits. It has been discovered that many players are driven to change tables in order to stay interested, excited, challenged, etc. Often, players switch back and forth between Poker and Blackjack; however, it is unfeasible for the casino to arrange for Blackjack hands and Poker hands to be switched at the same table every time a player changes his/her interest.

Thus, the casinos have the challenge of how to maintain maximum and continuous interest of the players so they will want to visit the casinos often and to play continuously with little loss of attention or enthusiasm. Obviously, the casinos hope the players will bet more, leading to greater profits for the "house".

In summary, it is always desired to find a game that is easy to play and also fast moving. When the player is provided with a considerable amount of participation and additional and greater winning possibilities based on new card combinations, these games become much more attractive and enjoyable.

SUMMARY OF THE NEW INVENTION

This new card game provides pleasure, challenge, and excitement to players and observers and provides casino operators with a new wagering card game variation which will make the players/patrons happier and more eager to play and bet more, and correspondingly make the casinos more competitive with other casinos not having the new game and more profitable.

One object of the new game is merely to provide a new wagering card game. More particularly, it is an object of this invention to provide a variation of Poker and a variation of Blackjack, because both are long proven highly popular with the patrons and highly profitable games for the casinos.

Pojack is for players who want the excitement and entertainment of this new game which combines selected elements of Blackjack and Poker. The Pojack playing table and cards permit playing standard Blackjack; however, players who want to play only Blackjack would probably go to a standard Blackjack table, and players who want to play only Poker would probably go to a standard Poker table. Thus, the new game will be described as it would be played where at least one player at the table or all the players wish to play Pojack.

In the new Pojack game the dealer uses a card shoe containing six to eight standard fifty-two card decks as typically shuffled to play Blackjack.

To begin Pojack, each player indicates his/her election to play only Blackjack or to play only Poker or to play Pojack. Such election is done by each player placing a Poker ante bet or a Blackjack bet or both in the betting area situated in front of him/her. This Blackjack phase of Pojack is played according to standard Blackjack rules except as described below. Two cards are dealt face up to every player, and then additional cards are dealt face up only to the Blackjack players to completion of their hands; however, before the dealer turns up his hole card, each Blackjack player who has placed a Poker bet and now knows how his Blackjack hand will look as a Poker hand, must make a Poker raise bet or be barred from the Poker phase of that hand. Also, now each Poker only player, who now has two cards must make his raise bet or be barred from playing out the Poker phase of the hand. The dealer then turns up his hole card and completes the Blackjack phase with appropriate payouts and collections to only the Blackjack players.

Now the Poker phase begins. The eligible players for this Poker phase are the Blackjack players who did make a Poker raise bet at the required time, and players who elected to play only Poker from the beginning of the hand. The dealer deals cards to those players whose Blackjack hands contained fewer than five cards until each player has five cards. Where a player's Blackjack hand had greater than five cards or where the hand had been split, special rules have been developed as described in detail in other sections below.

For those players who elected to play only Poker, their ante bets were placed at the beginning of the hand and their raise bets were placed at the same time as that of the Blackjack players.

This game of Pojack has significant differences from standard Blackjack and standard Poker. The result is a new game that is highly desired by players for its excitement, challenge and greater betting and winning possibilities and is highly desired by casinos for its ability to attract more players and to provide an incentive to them to play longer and bet more, leading to greater profits for the casino.

Other aspects of Pojack which make it highly attractive to casinos for financial and promotional reasons include:

a. It requires no new paraphernalia except a felt table cover with Pojack graphics.

b. It is easy to set up and play with a standard Blackjack card shoe filled with six to eight 52-card decks.

c. It is easy for the dealer and the players to learn and easy for the dealer to deal.

d. It is more fast moving and more exciting and challenging than Blackjack or Poker alone because of the continuously changing parameters, particularly where each player has to assess the significance of each additional card as it may impact on his Blackjack hand and on his Poker hand, and where such card may cause good results in one hand and bad results in the other hand.

e. It offers vastly more possible card combinations and higher payout possibilities. As is well known, Poker is traditionally played with a single 52-card deck with only those 52 cards distributed among the players, the deck including only 4 aces, 4 twos, etc. In using eight decks there are obviously 32 aces, 32 twos, 32 threes, etc., and any single hand of five cards could contain 5 aces, 5 twos, etc. Pojack accommodates that possibility by providing a payout of 50-1 for five of a kind (mixed suit) and 500-1 for five of a kind (same suit). Also, there are new and higher Bonus payouts of $250 for five of a kind mixed suit and $1000 for five of a kind same suit.

Pojack requires constant alertness and awareness of new strategies, since an excellent hand in Blackjack may be predictive of a mediocre to poor hand in Poker or vice versa. Each Pojack player commits to playing both Blackjack and Poker with his/her initial Blackjack and Poker ante bets. Each Pojack player may later elect to not place the Poker raise bet and thus sacrifice his/her Poker ante bet, if his Blackjack hand does not look promising for a good Poker hand.

The Poker phase of Pojack has some similarities to the known game of Caribbean Stud Poker; however, Pojack in its overall concept is totally different in that a Blackjack hand becomes the foundation of the Poker hand and in that the six to eight or other multiple decks in the card shoe provide vastly greater mathematical odds to obtain desired combinations than normally available from a single 52-card deck.

DETAILED DESCRIPTION OF THE PREFERRED EMBODIMENT

Players have a choice of playing Blackjack, Poker or Pojack. If all players wish to play only Blackjack, the dealer can proceed with standard Blackjack according to the house rules. However, if any player wishes to play Pojack, which combines certain elements of Blackjack and Poker, the dealer proceeds with the Pojack rules. In the new game of Pojack, the dealer uses a card shoe containing six to eight standard fifty two card decks as typically shuffled and used to play Blackjack. Other numbers of multiple decks could be used with appropriate consideration for the change in the odds.

Figure 1:
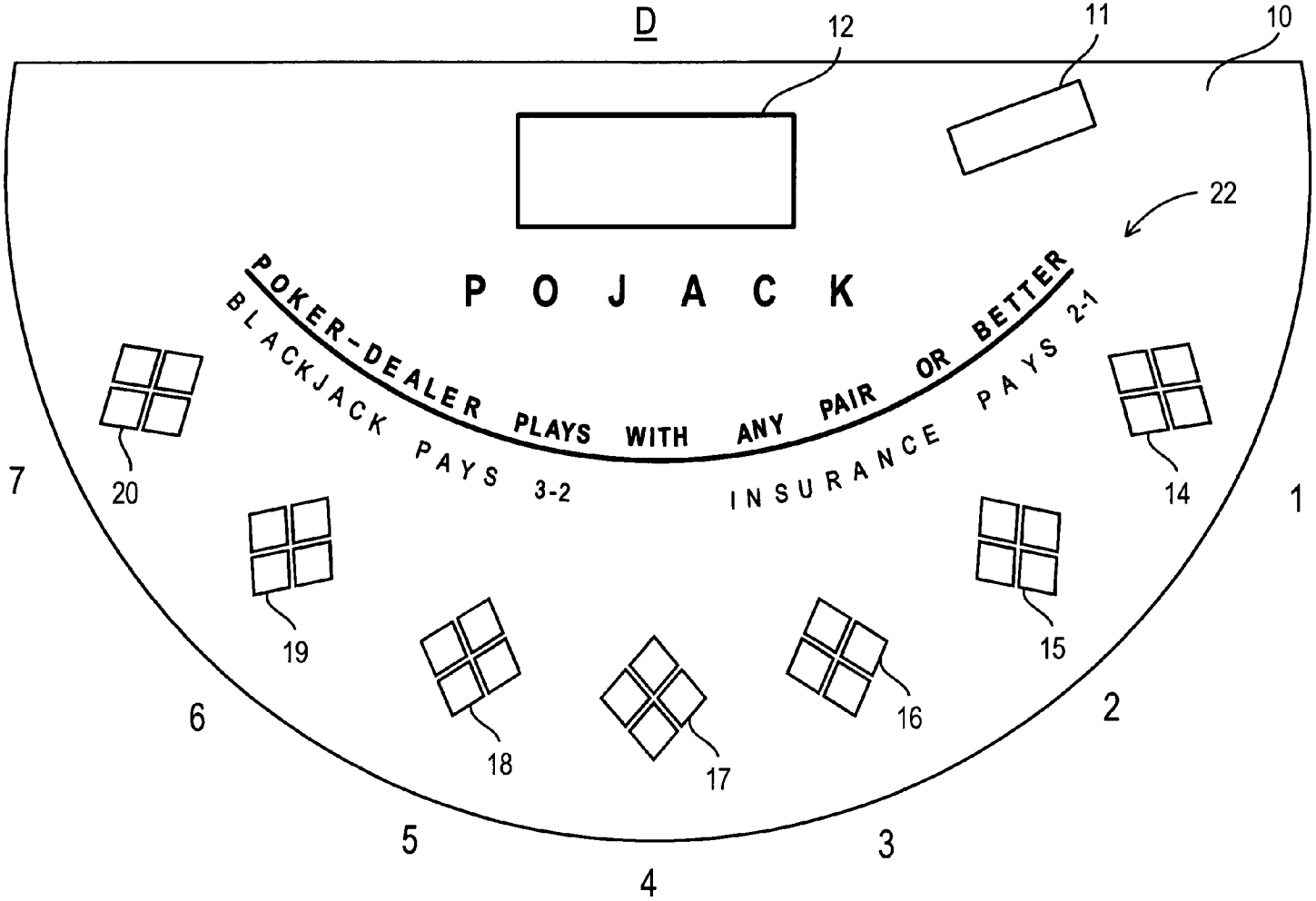
FIG. 1 is a plan view of a Pojack layout on a standard card table.
Figure 2:
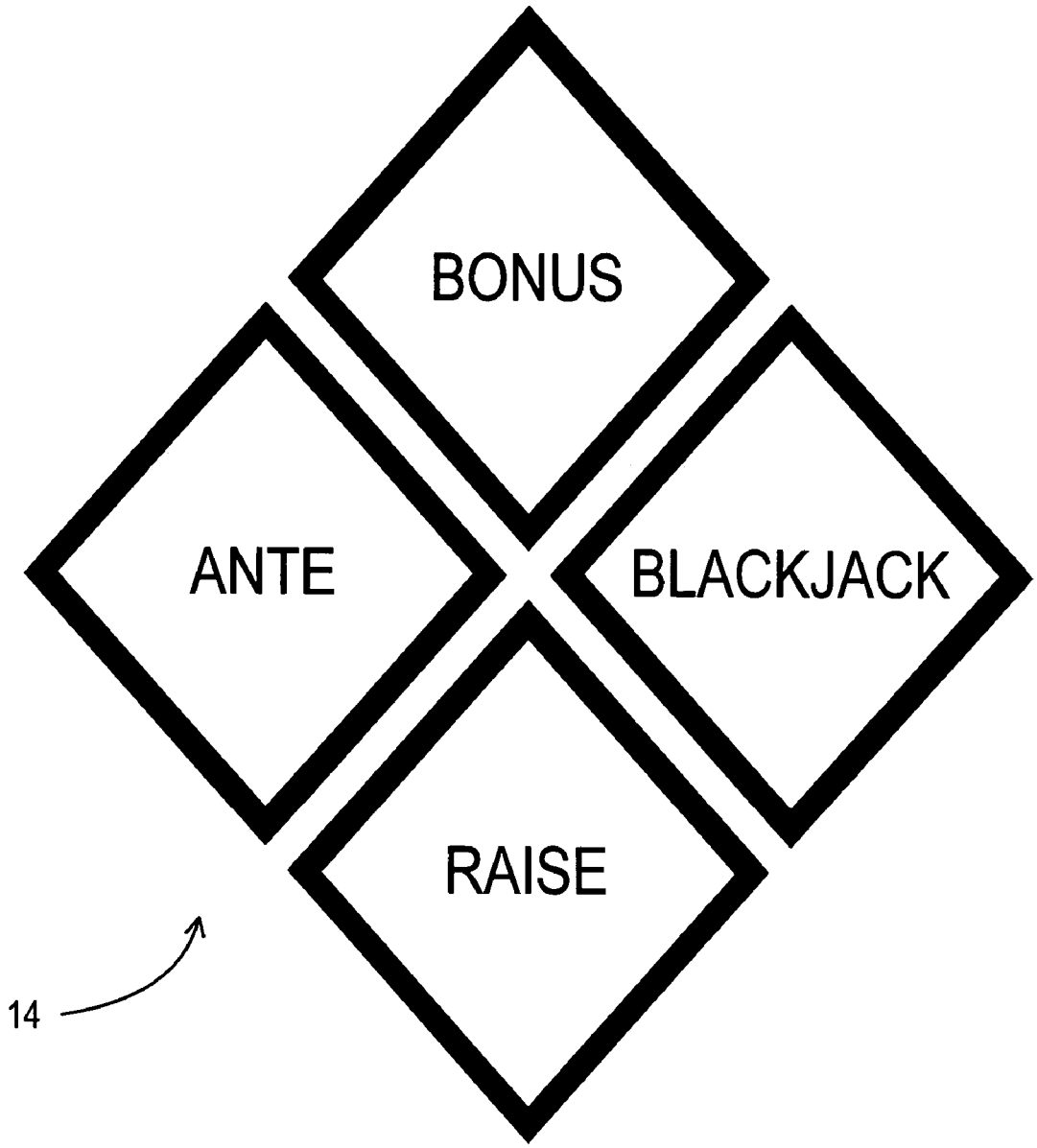
FIG. 2 is an enlarged plan view of the Pojack betting area.

The new Pojack game is played on a standard Blackjack table covered with the new Pojack layout felt cover 10, a standard Blackjack card shoe 11 and a chip tray 12, as seen in FIGS. 1 and 2. In this layout the dealer stands behind the table at position D adjacent card shoe 11, and up to seven players are seated at positions 1–7, spaced in a crescent around the front of the table. Adjacent these player positions are betting areas 14–20 respectively, shown as diamond-shaped boxes in this embodiment, and between the betting areas and the card shoe 11 is a banner-like statement 22 of the house rules for this table at this house or casino.

FIG. 2 shows an expanded view of the typical betting area 14 containing diamond-shaped designations "Ante", "Blackjack", "Bonus" and "Raise" which will be discussed later.

Pojack play begins as a normal game of Blackjack, and at the end of each Blackjack hand the players have the option to play Poker. To begin, the dealer uses a standard Blackjack card shoe 11 of six to eight decks of cards, depending on the house rules. The cards are shuffled, and one to two decks are cut from the back of the shuffled cards as in a standard Blackjack game.

Next is initial betting. The four possible bets to play in Pojack are:

1) Blackjack bet
2) Poker ante bet
3) Bonus bet (which is optional)
4) Poker raise bet In order for a player to play at all, he must place a Blackjack bet or a Poker ante bet or both. Each casino will establish its own house rules: (a) as to the minimum and maximum value of each Blackjack bet or Poker ante bet, and (b) as to whether these Blackjack and Poker bets must be of equal value or may be of different values. The Bonus bet is an option, as will be explained later. All bets are placed in the designated betting areas 14 through 20.

To play Pojack, each player elects: (a) to play only Blackjack, or (b) to play Blackjack with an option to decide later to play Poker, or (c) waits to play only Poker at the end of the Blackjack portion of the hand. For the Blackjack phase the player must put up the Blackjack bet. To have the possibility to play Poker later with his Blackjack hand, the player must put up a Poker ante before the Blackjack phase. To play only Poker the player must put up a Poker ante before the Blackjack phase begins. At this initial betting phase each player of Pojack or Poker may make an optional Bonus bet to cover the situation of the dealer failing to receive his "any pair or better" to qualify.

Next, the dealer deals two cards face up to every player who has placed a Blackjack bet or a Poker ante bet. Then the dealer deals cards for the Blackjack phase to the Blackjack players (and not to the Poker only players) in a standard manner to the point in time when all players who are playing Blackjack have drawn the cards they requested and before the dealer turns over his hole card. At this point and before the dealer turns over his hole card, all those players who have made Poker ante bets at the beginning of the hand are invited by the dealer to elect now to play Poker later. Thus, the players playing only Poker must now raise, and the players playing Blackjack with an option to play Poker must now raise. This raise bet may be the same or double the Poker ante bet, depending on the rules of each particular casino.

Any player who originally placed the Poker ante bet and does not now place a Poker raise bet, will lose his Poker ante bet. Any such player who does not raise and is not still playing Blackjack and who has now lost his Poker ante will have his cards removed. Now that the Poker Raise bets are made, the dealer will conclude the Blackjack game, whereby all Blackjack bets will be paid, taken or pushed.

Now the dealer proceeds into the Poker game with only those players who placed a Poker raise bet. The dealer will deal enough cards to each player in order, until each player has five cards. Thus, if player No. 1 had a ten and a face card from his Blackjack hand, he will receive three additional cards. If player No. 2 had five cards showing from his Blackjack hand, they would become his Poker hand, and he would be dealt no additional cards. If player No. 3 had two hands from a split pair, the first hand would become his Poker hand which would include the Blackjack hand cards plus any newly dealt cards to reach a five card count. From a Double Down situation the three Blackjack cards receive two additional cards for the new Poker hand. If player No. 4 was playing only Poker, he would have already received two cards face up during the Blackjack phase and would now receive three additional cards face up to complete his five card hand.

A still further circumstance would be where player No. 5 had six cards from his Blackjack hand. Here, the last card he received would be removed, and the first five cards would constitute his Poker hand. If the hand played from a split which had more than five cards, only the first five cards would become his Poker hand.

Finally, the dealer would take for his own hand additional cards sufficient to have five, according to the same rules above as for the players.

In this preferred embodiment of Pojack a player can win only if he beats the dealer, and the dealer cannot qualify unless he has one pair or better. Individual casinos may modify these rules.

If the dealer does not qualify with at least one pair:

a. each player who made no Bonus bet wins only his ante bet and raise bets are returned, and b. each player who made a Bonus bet (typically the casino allows a $1.00 bet) and has a straight or higher is paid a payout according to the Bonus Payout Schedule shown below.

Bonus Payout Schedule

| Player's Hand | Payout |
|---|---|
| Straight | $5.00 |
| Flush | $10.00 |
| Full House | $25.00 |
| Four of a kind (mixed suit) | $50.00 |
| Four of a kind (same suit) | $100.00 |
| Straight flush | $100.00 |
| Royal flush | $500.00 |
| Five of a kind (mixed suit) | $250.00 |
| Five of a kind (same suit) | $1000.00 |

With respect to the above Bonus Payout Chart, the payout is double for any winning hand where the cards are of the same suit, except for hands already containing same suit-cards. Thus, a flush, straight flush, royal flush, and five of a kind same suit would not receive a double payout under the Bonus Payout schedule.

If the dealer does qualify with at least one pair, then each player's hand is compared to the dealer's hand, and a winning hand pays even money for the ante bet. All raise bets are paid odds according to the Poker Payout Schedule shown below.

Poker Payout Schedule

| | |
|---|---|
| One pair | 1-1 |
| Two pairs | 2-1 |
| Three of a kind | 2-1 |
| Straight | 4-1 |
| Flush | 5-1 |
| Full house | 6-1 |
| Four of a kind (mixed suit) | 15-1 |
| Four of a kind (same suit) | 30-1 |
| Straight flush | 50-1 |
| Five of a kind (mixed suit) | 50-1 |
| Royal flush | 100-1 |
| Five of a kind (same suit) | 500-1 |

If a player and the dealer have equally ranked Poker hands, the hand is a push and players' bets are returned. The bets are neither paid nor taken.

All winning hands are based on the dealer qualifying. This includes the Pojack Jackpot hand which is called "POJACK". This hand requires five cards of the same value in the same suit, examples being five queens of diamonds or five jacks of hearts, otherwise called a five-card flush.

A further optional feature of Pojack is the Progressive Jackpot payout which requires a hand of five cards of the same value in the same suit, the same as the POJACK hand discussed above. The Progressive Jackpot payout is the sum of money that has accumulated in the Progressive Jackpot according to the house rules of the casino. Payout is made as follows:

a. If a player has made the Bonus bet and the dealer qualifies, the player is paid the Progressive Jackpot plus the 500 to 1 payout shown in the Poker Payout Schedule for five of a kind (same suit).

b. If a player has not made the Bonus bet and the dealer qualifies, the player is paid the Progressive Jackpot only.

c. If a player has not made the Bonus bet and the dealer does not qualify, the player is paid his ante bet only; the player does not win the Progressive Jackpot, and the raise portion of his bet is a push.

The game of POJACK invites and requires new strategies of play because of the greatly increased total number of cards in play due to the multiple decks of cards and the new rules that are applied to certain traditional plays in Blackjack and Poker. Two such situations are Splitting and Double Down, as follows:

Splitting:

a. When playing Blackjack there are times when it is advisable to split a pair of cards. Most strategies say to split aces and eights. The option is a benefit to the player. When splitting aces the player has the chance of getting two hands of 21 points each, namely two winning hands for the player. When splitting a pair of 8's the player has a chance of getting two hands of 18 points each which could be two winning hands for the player, again a benefit for the player.

b. The traditional Splitting strategy from Blackjack changes in the game of Pojack. In Pojack the player will not likely opt to keep the pair hoping to get a win in the Poker hand. This now becomes a benefit to the casino, because instead of the casino paying out on two winning Blackjack hands, the casino has the possibility of winning the poker hand.

Double Down:

a. Whenever a player has two cards totaling 10 or 11 he has the option to Double Down which is usually a benefit to the player. In the game of Pojack the player may just hit, getting the option of seeing more cards dealt to the other players. By watching the other cards, the player now tries to see whether or not to play Poker. The disadvantage to the player in this action is the player must make his raise bet to play Poker. This now becomes an advantage to the casino.

Thus, the new game of Pojack provides a variety of new and interesting strategies and betting possibilities and winning or payout possibilities for the players' which the players are likely to be more enthusiastic about the game, and it also provides situations which induce the player's to make more and higher bets with advantageous odds to the house, such that the house is likely to make greater profits.

In setting up the Pojack games rules there are numerous options a casino may choose:

a. Pojack maybe played with two or more standard decks, with six or eight being the expected choice.

b. Jokers and/or wild cards maybe allowed to more easily produce better hands and also to allow this using fewer decks of cards.

c. A player could be given the option of choosing from the six or seven cards in his Blackjack hand to make his five-card Poker hand.

d. A player may be given the option to draw (exchange) one or more cards to better his Poker hand. This option may also require the player to pay a fee for each card that he exchanges.

e. In the case of Splitting, the player may be given the option of choosing which hand will become his Poker hand. This would be done before the player receives any additional cards.

f. Another option in Splitting would be to create two or more Poker hands by making an additional ante wager. A casino usually allows no more than three Splits in a Blackjack hand. Those three Splits may all become Poker hands or not. This would be at the players' discretion.

g. Poker Payout and Bonus Payout schedules may be varied.

h. Dealer qualifications may be varied.

Still further possible variations of Pojack include the following:

a. A casino may allow each player to receive all five cards before he places his bet. Accordingly, after completing the blackjack hand, the dealer would give additional cards to the player to complete the five card poker hand, so the player can decide to place his raise bet. Since this might reduce the house odds, it is not desirable for the casino; however, the casino may decide to include this feature as a sweetener to encourage more players. If the casino allows these extra cards after the raise bet is placed, the dealer would then continue to the next player to play blackjack, dealing up to a five card total for poker and then to the next player for blackjack, poker, etc.

b. The casino may establish a 2-1 instead of 3-2 payoff for a player who gets a blackjack and it is a suited blackjack. Note: to receive the 2-1 payoff the player must have placed his poker ante bet.

c. The casino may vary the bonus payoff schedule so that it starts with a straight or better. Accordingly, if the one dollar bonus is placed the player would receive $1 for a pair, $2 for two pair, or $3 for three of a kind. This is only added to the BONUS pay out schedule.

d. The casino may allow a player to play more then one hand of Pojack at once at a single table.

The new Pojack game described herein can be played not only on card tables in casinos, but on electronic video game machines, on personal computers, on the Internet and of course casually anywhere. The invention herein is thus applicable to casual playing and for conducting wagering card games in business establishments.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

The invention claimed is:

1. A method of playing a wagering card game which includes selected elements of the games of Blackjack and Poker, said wagering card game being played between a dealer and one or more players, where the dealer deals from a stack of cards containing at least six standard 52-card decks of cards and the Poker payout odds are predetermined, Pojack comprising rules wherein:

a. each player elects to play Blackjack or Poker or both by placing a Blackjack bet or a Poker ante bet or both respectively, b. then the dealer deals according to standard Blackjack procedure to all those players who elected to play Blackjack, c. then before the dealer turns over his hole card and before he makes the Blackjack payout or collection to the players playing Blackjack, each player who previously made a Poker bet is invited to play Poker using his Blackjack hand as the beginning of his Poker hand by placing a Poker raise bet, d. then each player electing to play Poker places his raise bet, e. then the dealer turns over his hole card and makes Blackjack payouts or collects to all Blackjack players of that Blackjack hand, f. then the dealer deals sequentially to each of said players who elected to play Poker, where each of said Poker players is dealt sufficient cards so that his hand includes a total of five cards to comprise a standard Poker hand, this step being modified such that;

(i) if any player's Blackjack hand included more than five cards, only the first five cards become his Poker hand and the additional cards are discarded, and (ii) if any player's Blackjack hand had been split, only the first split becomes his Poker hand, and for this first split rule f(i) is applied, g. then the dealer completes his own Poker hand, and h. then the dealer pays out or collects on all Poker ante and raise bets of all the players playing this Poker hand, according to the predetermined payout odds, where the predetermined Poker bet payout odds are:

| | |
|---|---|
| One pair | 1-1 |
| Two pairs | 2-1 |
| Three of a kind | 2-1 |
| Straight | 4-1 |
| Flush | 5-1 |
| Full House | 6-1 |
| Four of a kind (mixed) | 15-1 |
| Four of a kind (same suit) | 30-1 |
| Straight flush | 50-1 |
| Royal Flush | 100-1 |
| Five of a kind (same suit) | 500-1. |

2. A method according to claim 1, where in each Poker game the dealer must have a pair or better to qualify, and if the dealer fails to qualify, each player playing that hand wins his ante bet and that game is concluded.

3. A method according to claim 1, where in step (c), the dealer, before turning over his hole card, removes the cards and Poker ante for each player who is not playing Blackjack and who did not place a raise bet for the Poker hand.

4. A method according to claim 1, where in step (a) at the time each player places his Blackjack bet or Poker ante bet or both, he has the option to place a Bonus bet of predetermined value which can be made only at that time, and he places that bet if he so elects, and later in step (h) the dealer collects or pays out on the Bonus bets according to predetermined odds.

5. A method according to claim 4 comprising the further step of providing a playing surface which includes a plurality of betting areas, where each of said betting areas is adapted for use by one player and each of said betting areas comprise a set of four sub-areas respectively for the Blackjack bet, the Poker ante bet, the Poker raise bet and the Bonus bet.

6. A method according to claim 5 wherein each of said betting areas comprise four sub-areas which are spaces apart and define a generally diamond shape.

7. A method according to claim 5 wherein said plurality of betting areas are spaced apart and define a generally concave crescent shape.

8. A method according to claim 1, where the Bonus bet is one dollar.

9. A method according to claim 1, where the Bonus bet is one dollar and the payout odds are as follows:

| | |
|---|---|
| Straight | $5.00 |
| Flush | $10.00 |
| Full House | $25.00 |
| Four of a kind (mixed suit) | $50.00 |
| Four of a kind (same suit) | $100.00 |
| Straight flush | $100.00 |
| Royal flush | $500.00 |
| Five of a kind (mixed suit) | $250.00 |
| Five of a kind (same suit) | $1000.00. |

10. Conducting a wagering card game in a casino where said game is played according to the method of claim 1.

11. A method of playing a wagering card game which includes selected elements of Blackjack and Poker, said wagering card game being played between a dealer and one or more players, on a playing surface which includes a plurality of betting areas, where each of said betting areas is adapted for use by one player and each of said betting areas comprise a set of at least three sub-areas respectively for the Blackjack bet, the Poker ante bet and the Poker raise bet, where the dealer deals from a stack of cards containing at least six standard 52-card decks of cards and the Poker payout odds are predetermined, said Pojack comprising rules wherein:

a. each player elects to play Blackjack or Poker or both by placing a Blackjack bet or Poker ante bet or both respectively, b. then the dealer deals according to standard Blackjack procedure to all those players who elected to play Blackjack, c. then before the dealer turns over his hole card and before he makes the Blackjack payout or collection to the players playing Blackjack, each player who previously made a Poker bet is invited to play Poker using his Blackjack hand as the beginning of his Poker hand by placing a Poker raise bet, d. then each player electing to play Poker place his raise bet, e. then the dealer turns over his hole card and makes Blackjack payouts to or collections from all Blackjack players of that Blackjack hand, f. then the dealer deals sequentially to each of said players who elected to play Poker, where, each of said Poker players is dealt sufficient cards so that his hand includes a total of five cards to comprise a standard Poker hand, this step being modified such that;

(i) if any player's Blackjack hand included more than five cards, only five of these cards become his Poker hand and the additional cards are discarded, and (ii) if any player's Blackjack hand had been split, only one of said splits becomes his Poker hand, and for this split rule f(i) is applied, g. then the dealer completes his own Poker hand, and h. then the dealer pays out or collects on all Poker ante and raise bets of all players playing this Poker hand according to the predetermined payout odds.

12. A method according to claim 11, where in step (d), each player who does not place a raise bet is eliminated from being able to play Poker with this hand, and the dealer collects his Poker ante bet.

13. A method according to claim 11, where in step f(i) the player determines which five cards he will use for his Poker hand.

14. A method according to claim 11, where in step (f)(ii) the player determines which split he will use for his Poker hand.

15. A method of conducting a wagering card game according to claim 11 in a casino, where the casino provides a dealer and the casino determines the predetermined Poker pay out odds.

16. A method according to claim 15 where said casino sets said predetermined Bonus bet value and Bonus payout odds.

17. A method according to claim 15 where said casino sets said predetermined qualification requirement for said dealer in said Poker hands.

18. Conducting a wagering card game in a casino where said game is played according to the method of claim 11.

* * * * *